US010261444B2

(12) United States Patent
Shirayanagi

(10) Patent No.: US 10,261,444 B2
(45) Date of Patent: Apr. 16, 2019

(54) DEVELOPING APPARATUS

(71) Applicant: CANON KABUSHIKI KAISHA, Tokyo (JP)

(72) Inventor: Jun Shirayanagi, Ushiku (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/599,664

(22) Filed: May 19, 2017

(65) Prior Publication Data

US 2017/0343928 A1 Nov. 30, 2017

(30) Foreign Application Priority Data

May 27, 2016 (JP) ..... 2016-106742

(51) Int. Cl.
*G03G 15/08* (2006.01)
*G03G 15/09* (2006.01)
*G03G 15/02* (2006.01)

(52) U.S. Cl.
CPC ..... *G03G 15/0893* (2013.01); *G03G 15/0233* (2013.01); *G03G 15/0935* (2013.01);
(Continued)

(58) Field of Classification Search
CPC ..... G03G 15/0887; G03G 15/0889; G03G 15/0891; G03G 15/0893; G03G 15/0233; G03G 15/0935; G03G 15/0216
See application file for complete search history.

(56) References Cited

U.S. PATENT DOCUMENTS 8,224,212 B2 7/2012 Murauchi et al.
2013/0121724 A1* 5/2013 Nittani ..... G03G 15/0891 399/111

(Continued)

FOREIGN PATENT DOCUMENTS

JP S59-100471 A 6/1984
JP 2004-205706 A 7/2004

(Continued)

OTHER PUBLICATIONS

Osamu Ariizumi, et all, U.S. Appl. No. 15/460,317, filed Mar. 16, 2017.

*Primary Examiner* — Carla J Therrien
(74) *Attorney, Agent, or Firm* — Venable LLP

(57) ABSTRACT

A developing apparatus includes a rotatable developer carrying member, a first chamber to supply developer to the developer carrying member, and a second chamber to collect the developer from the developer carrying member. A first conveyance screw in the first chamber conveys the developer in a first conveyance direction, and a second conveyance screw conveys the developer in the second chamber. The second conveyance screw includes a rotary shaft, a first vane portion, and a second vane portion provided downstream of the first vane portion. A developer discharge portion is disposed upstream of the second vane portion in the first conveyance direction and discharges excess developer. The developer discharge portion is disposed in a predetermined area of the second chamber in which the developer is deliverable to a communication portion, and is provided in a bottom portion in the predetermined area of the second chamber.

6 Claims, 5 Drawing Sheets

(52) U.S. Cl.
CPC ..... *G03G 15/0216* (2013.01); *G03G 15/0887* (2013.01); *G03G 15/0921* (2013.01); *G03G 2215/083* (2013.01); *G03G 2215/0833* (2013.01)

(56) References Cited

U.S. PATENT DOCUMENTS

| | | | | |
|---|---|---|---|---|
| 2015/0003876 | A1* | 1/2015 | Iida | G03G 15/0891 399/254 |
| 2015/0132027 | A1* | 5/2015 | Kashimoto | G03G 15/0891 399/254 |
| 2015/0139696 | A1* | 5/2015 | Ishida | G03G 15/0893 399/254 |
| 2015/0153678 | A1* | 6/2015 | Sakamaki | G03G 15/0921 399/272 |
| 2015/0301477 | A1* | 10/2015 | Akedo | G03G 15/0893 399/254 |
| 2015/0331360 | A1* | 11/2015 | Akedo | G03G 15/0887 399/254 |

FOREIGN PATENT DOCUMENTS

| | | | |
|---|---|---|---|
| JP | 2009-211087 | A | 9/2009 |
| JP | 2010-186099 | A | 8/2010 |
| JP | 2011-002773 | A | 1/2011 |

* cited by examiner

DEVELOPING APPARATUS

BACKGROUND OF THE INVENTION

Field of the Invention

The present invention relates to a developing apparatus, which is suitable for an image forming apparatus using an electrophotographic technology, such as a printer, a copying machine, a facsimile machine, or a multifunction peripheral.

Description of the Related Art

An image forming apparatus such as a printer, a copying machine, a facsimile machine, or a multifunction peripheral includes a developing apparatus configured to develop an electrostatic latent image formed on a photosensitive drum with a developer so as to form a visible image. As such a developing apparatus, there is known a developing apparatus having a function separation type configuration including a developing chamber from which the developer is supplied to a developing sleeve and an agitating chamber in which the developer removed by the developing sleeve is collected, and the developer is circulated between the developing chamber and the agitating chamber (Japanese Patent Application Laid-Open No. 2004-205706 and Japanese Patent Application Laid-Open No. 2009-211087).

In the developing apparatus, a dual-component developer (hereinafter referred to simply as "developer") containing a non-magnetic toner and a magnetic carrier is used. In this case, the toner is consumed during image formation, whereas the carrier is repeatedly used without being consumed. However, the carrier repeatedly used for a long period of time is degraded in charging performance for the toner. When the developer containing a large amount of such carrier is continuously used, an image defect such as a density unevenness or fogging is liable to occur. Therefore, in order to replenish approximately the same amount of toner as the amount of consumed toner and to suppress the degradation of the carrier, there is known an apparatus using a carrier refresh (ACR: Auto Carrier Refresh) process of replenishing a supplement containing the toner and the carrier and discharging a surplus developer (Japanese Patent Application Laid-Open No. S59-100471).

In the case of the developing apparatus of the function separation type, when the developer is brought into a stable state (so-called steady state), a surface level of the developer becomes higher from upstream toward downstream in a direction in which an agitating screw conveys the developer. Thus, the developer is liable to accumulate downstream of the agitating chamber, that is, upstream of the developing chamber. Therefore, when the ACR process is used for the developing apparatus of the function separation type, a discharge port configured to discharge the surplus developer is formed downstream of the agitating chamber. In the related-art developing apparatus of the function separation type using the ACR process, however, even when the amount of developer is relatively small, the developer is liable to be continuously discharged. Thus, with the related art, the amount of developer is excessively reduced, and a sufficient amount of developer cannot be supplied to the developing sleeve, resulting in occurrence of the image defect.

SUMMARY OF THE INVENTION

The present invention has been made in view of the problem described above, and has an object to provide a developing apparatus which has a configuration of a function separation type using a carrier refresh process, and is configured to reduce excessive discharge of a developer as compared to the related art.

A developing apparatus according to one embodiment of the present invention, comprising:

a developer carrying member configured to carry and convey a developer;

a first chamber configured to supply the developer to the developer carrying member;

a second chamber which is provided adjacent to the first chamber in a horizontal direction and is configured to form a circulation route for the developer in cooperation with the first chamber and collect the developer from the developer carrying member;

a first conveyance member which is disposed in the first chamber and is configured to convey the developer in a first direction;

a second conveyance member which is disposed in the second chamber and includes a conveyance portion configured to convey the developer in a second direction opposite to the first direction in the second chamber;

a return conveyance portion which is provided downstream of the conveyance portion in the second direction and is configured to convey the developer in the first direction in the second chamber;

a first partition wall which is provided between the first chamber and the second chamber to form a first communication portion configured to deliver the developer from the second chamber to the first chamber downstream in the second direction and a second communication portion configured to deliver the developer from the first chamber to the second chamber upstream in the second direction, the first communication portion confronting the return conveyance portion; and a bearing member configured to rotatably support an end portion of the second conveyance member on a side closer to the first communication portion, the bearing member including:

(i) a discharge port which is provided downstream of the return conveyance portion in the second direction and is configured to discharge the developer; and (ii) a second partition wall which extends from the bearing member in the first direction and is configured to cover a portion of the return conveyance portion corresponding to the first communication portion, wherein the second partition wall is arranged so as to confront the first communication portion.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

[First Embodiment]

Figure 1:
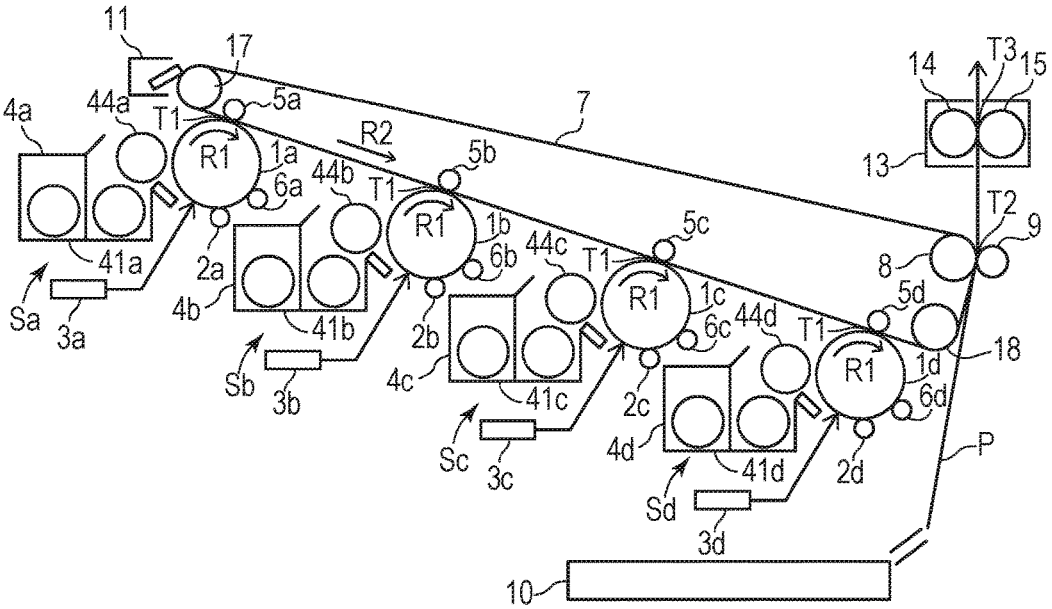
FIG. 1 is a schematic view for illustrating a configuration of an image forming apparatus using a developing apparatus according to a first embodiment.

A first embodiment will be described with reference to FIG. 1 to FIG. 3. First, a schematic configuration of an image forming apparatus using a developing apparatus of the first embodiment will be described with reference to FIG. 1. The image forming apparatus illustrated in FIG. 1 is a tandem-type full-color printer using an intermediate transfer process, in which image forming portions (image forming stations) Sa, Sb, Sc, and Sd are arranged along an intermediate transferring belt 7.

<Image Forming Apparatus>

In the image forming portion Sa, a yellow toner image is formed on a photosensitive drum 1*a* and is then transferred onto the intermediate transfer belt 7. In the image forming portion Sb, a magenta toner image is formed on a photosensitive drum 1*b* and is then transferred onto the intermediate transfer belt 7. In the image forming portions Sc and Sd, a cyan toner image and a black toner image are formed on photosensitive drums 1*c* and 1*d*, respectively, and are then transferred onto the intermediate transfer belt 7. The toner images of the four colors transferred onto the intermediate transfer belt 7 are conveyed to a secondary transfer portion T2 so as to be secondarily transferred onto a recording material P (sheet material such as a paper sheet or an OHP sheet) at a time.

The image forming portions Sa, Sb, Sc, and Sd are configured in substantially the same manner except for differences of colors of the toners to be used in developing apparatus 4*a*, 4*b*, 4*c*, and 4*d*, specifically, yellow, magenta, cyan, and black. Configurations and operations of the image forming portions Sa to Sd will be described below with omission of the suffixes of a, b, c, and d in the reference symbols, which allow distinction between the image forming portions Sa, Sb, Sc, and Sd.

In the image forming portion S, there are arranged a primary charger 2, an exposure device 3, the developing apparatus 4, a primary transfer roller 5, and a secondary charger 6 so as to surround the photosensitive drum 1 serving as an image bearing member. The photosensitive drum 1 includes a cylinder made of aluminum and a photoconductive layer formed on an outer peripheral surface of the cylinder. The photoconductive layer is an organic photoconductor having a negative charging characteristic. The photosensitive drum 1 is rotated at a predetermined process speed, for example, at 250 mm/sec in a direction indicated by the arrow R1 in FIG. 1. The photosensitive drum 1 is formed to have, for example, a diameter of 30 mm and a length of 360 mm in a rotation axis direction (longitudinal direction).

The primary charger 2 is, for example, a charging roller having a roller shape. A charging voltage is applied to the primary charger 2 by a high-voltage power supply (not shown), and the primary charger 2 is brought into contact with the photosensitive drum 1 to charge the photosensitive drum 1 to a uniform negative-polarity dark section potential. The charging roller as the primary charger 2 is urged toward the photosensitive drum 1 by a pressure spring (not shown), and hence is rotated to follow rotation of the photosensitive drum 1. As the charging voltage to be applied to the charging roller, for example, a superimposed voltage obtained by superimposing an AC voltage being a peak-to-peak voltage of 1,500 V onto a DC voltage of −900 V is applied. The charging roller is formed to have, for example, a diameter of 14 mm and a length of 320 mm in the rotation axis direction (longitudinal direction).

In the exposure device 3, a laser beam obtained by subjecting data of scanning-line images, which are expanded from decomposed color images of respective colors, to ON-OFF modulation is emitted from a laser emitting element. The laser beam is deflected by a rotary polygon mirror to form an electrostatic latent image of an image on a surface of the charged photosensitive drum 1. The secondary charger 6 arranged upstream of the primary charter 2 in a direction of rotation of the photosensitive drum 1 is a charging assistance apparatus configured to assist charging of the primary charger 2. The developing apparatus 4 is configured to supply a toner to the photosensitive drum 1 to develop the electrostatic latent image into a toner image. The developing apparatus 4 will be described in detail later (see FIG. 2 and FIG. 3).

The primary transfer roller 5 is arranged so as to be opposed to the photosensitive drum 1 across the intermediate transfer belt 7. The primary transfer roller 5 forms a primary transfer portion (primary transfer nip portion) T1 for the toner image between the photosensitive drum 1 and the intermediate transfer belt 7. In the primary transfer portion T1, a primary transfer voltage is applied to the primary transfer roller 5 by a high-voltage power supply (not shown). As a result, the toner image is primarily transferred from the photosensitive drum 1 onto the intermediate transfer belt 7. Specifically, when the primary transfer voltage having a polarity opposite to a charging polarity of the toner is applied to the primary transfer roller 5, the toner image formed on the photosensitive drum 1 is electrostatically attracted to the intermediate transferring belt 7 so that the toner image is transferred.

Figure 2:
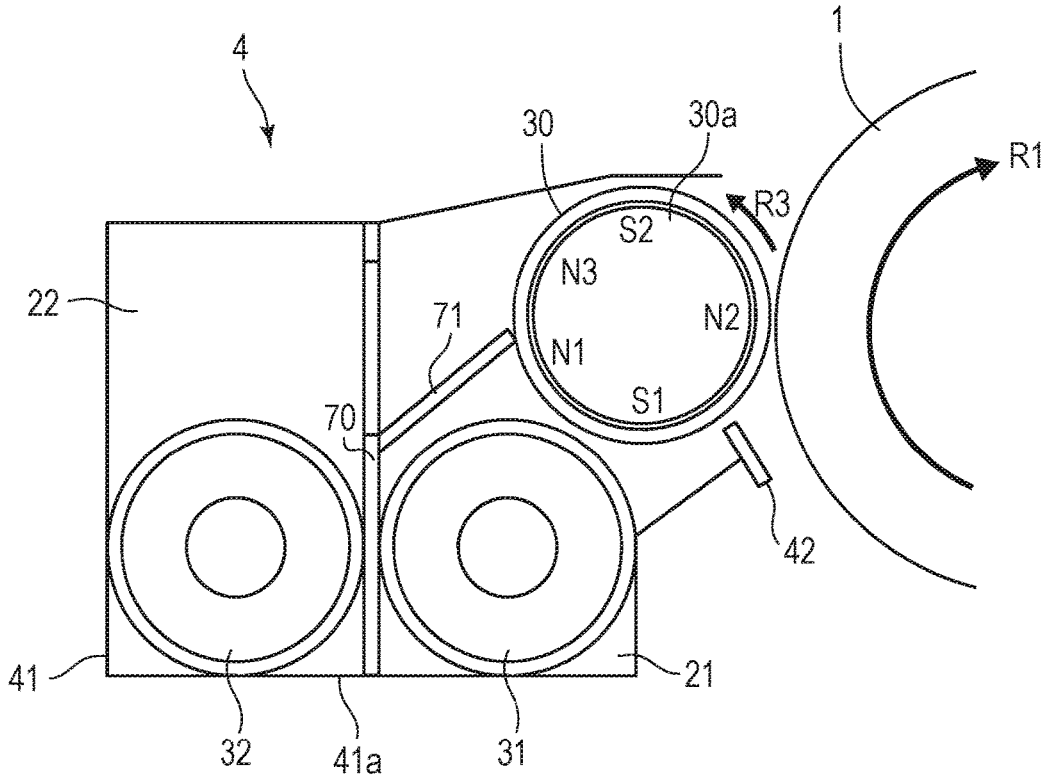
FIG. 2 is a sectional view for illustrating the developing apparatus according to the first embodiment.

The intermediate transfer belt 7 is stretched around rollers including an inner secondary transfer roller 8 and tension rollers 17 and 18 so as to be supported thereby, and is driven by the inner secondary transfer roller 8 also serving as a drive roller to rotate in a direction indicated by the arrow R2 in FIG. 2. The intermediate transferring belt 7 is driven at a speed approximately equal to the rotation speed (process speed) of the photosensitive drum 1. The secondary transfer portion T2 is a nip portion for transferring the toner images onto the recording material P and is formed by bringing an outer secondary transfer roller 9 into abutment against the intermediate transfer belt 7 supported by the inner secondary transfer roller 8. At the secondary transfer portion T2, a secondary transfer voltage is applied to the outer secondary transfer roller 9. In this manner, the toner images are secondarily transferred from the intermediate transfer belt 7 onto the recording material P conveyed to the secondary transfer portion T2. The recording materials P are stored in a sheet feeding cassette 10 in a stacked state, and are conveyed from the sheet feeding cassette 10 to the secondary transfer portion T2 by a sheet feeding roller (not shown), a conveyance roller (not shown), and registration rollers (not shown).

A secondary transfer residual toner remaining on and adhering to the intermediate transfer belt 7 after the secondary transfer is removed by a belt cleaning apparatus 11 rubbing the intermediate transfer belt 7. The belt cleaning apparatus 11 causes a cleaning blade to rub the intermediate transferring belt 7 to remove the secondary transfer residual toner.

The recording material P onto which the four-color toner image is secondarily transferred at the secondary transfer portion T2 is conveyed to a fixing device 13. In the fixing device 13, fixing rollers 14 and 15 are held in contact with each other to form a fixing nip T3. The toner image is fixed onto the recording material P at the fixing nip T3 while the recording material P is being conveyed. In the fixing device 13, the fixing roller 15 is brought into pressure contact with the fixing roller 14, which is heated from an inner side by a lamp heater (not shown), by an urging mechanism (not shown) to form the fixing nip T3. The recording material P is nipped and conveyed at the fixing nip T3 to be heated and pressurized so that the toner image is fixed onto the recording material P. The recording material P onto which the toner image is fixed by the fixing device 13 is discharged out of an apparatus main body.

<Developing Apparatus>

The developing apparatus 4 of the first embodiment will be described with reference to FIG. 2 and FIG. 3. The developing apparatus 4 includes, as illustrated in FIG. 2, a developing container 41, a regulating blade 42, a developing sleeve 30 as a developer carrying member, a developing screw 31 as a first conveying member, and an agitating screw 32 as a second conveying member.

In the developing container 41, a dual-component developer containing a non-magnetic toner and a magnetic carrier is stored. Specifically, a dual-component development process is used as a development process in the first embodiment, and the non-magnetic toner having negative charging polarity and the magnetic carrier having positive charging polarity are mixed to be used as the developer. The non-magnetic toner contains a colorant, an external additive such as colloidal silica fine powder, and further a wax in a resin such as polyester or styrene acrylic, and is formed as powder through grinding or polymerization. The magnetic carrier is formed by providing a resin coating on a surface layer of a core made of resin particles in which ferrite particles or magnetic powder is kneaded. A toner density of the developer in an initial state, that is, a ratio in weight of the toner with respect to the overall weight of the developer, is, for example, 8%.

The developing container 41 has an opening portion at a position opposed to the photosensitive drum 1. In the opening portion, the developing sleeve 30 is arranged rotatably so as to be partially exposed. The developing sleeve 30 is made of a non-magnetic material such as an aluminum alloy and is formed into a cylindrical shape. The developing sleeve 30 is driven to rotate at a predetermined process speed, for example, at 250 mm/sec in a direction indicated by the arrow R3 in FIG. 2. The developing sleeve 30 is formed to have, for example, a diameter of 20 mm and a length of 334 mm in the rotation axis direction (longitudinal direction). Inside the developing sleeve 30, a magnet roller 30*a* constructed by a plurality of magnetic poles is arranged irrotationally. As illustrated in FIG. 3, the developing sleeve 30 has a carrying area 30*b*, which is configured to carry the developer, in a middle portion in the rotation axis direction. The carrying area 30*b* has roughness on a surface. Non-carrying areas formed on both end portions of the developing sleeve 30 outside the carrying area 30*b* are smooth surfaces without an irregularity portion.

As illustrated in FIG. 2, the developing sleeve 30 is rotated in the direction indicated by the arrow R3 to carry and convey the developer, which is attracted at a position of a scooping magnetic pole N1, indicating a local maximum peak position of a magnetic flux density of a second magnetic pole, of the magnetic roller 30*a*, in a direction toward the regulating blade 42. When a magnetic brush of the developer formed by a regulating magnetic pole S1 passes through a gap between the developing sleeve 30 and the regulating blade 42, the regulating blade 42 applies a shear force to the magnetic brush. As a result, the magnetic brush is regulated in amount so that a developer layer having a predetermined layer thickness is formed on the developing sleeve 30. The formed developer layer is carried and conveyed to a developing area opposed to the photosensitive drum 1, and develops the electrostatic latent image formed on the surface of the photosensitive drum 1 in a state in which the magnetic brush is formed by a developing magnetic pole N2. The developer provided for development is removed from the developing sleeve 30 by a non-magnetic region formed between a removal magnetic pole N3, indicating a local maximum peak position of a magnetic flux density of a first magnetic pole, and the scooping magnetic pole N1 brought adjacent to each other.

The developing container 41 includes a developing chamber 21 as a first chamber and an agitating chamber 22 as a second chamber. A partition wall 70 configured to define the developing chamber 21 and the agitating chamber 22 is provided between the developing chamber 21 and the agitating chamber 22. The partition wall 70 as a first partition wall projects from a bottom surface 41*a* into the developing chamber 41 (into the developing chamber) to separate the developing chamber 21 and the agitating chamber 22 from each other. The partition wall 70 extends in the rotation axis direction (longitudinal direction) of the developing sleeve 30. In the developing apparatus 4 of the first embodiment, the developing chamber 21 and the agitating chamber 22 are arranged side by side approximately in a horizontal direction.

Figure 3:
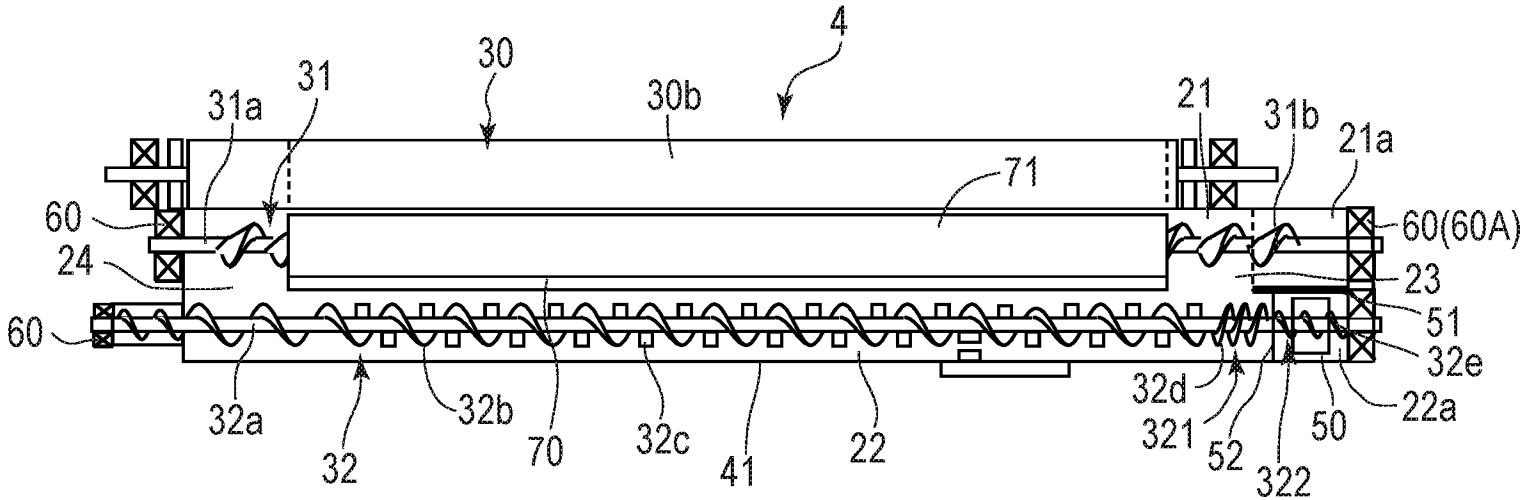
FIG. 3 is a top sectional view for illustrating the developing apparatus as viewed on a horizontal cross section including an axial direction.

As illustrated in FIG. 3, the partition wall 70 includes a first communication portion 23 and a second communication portion 24 which are configured to bring the developing chamber 21 and the agitating chamber 22 into communication with each other on both longitudinal end sides. In a case of the first embodiment, both ends of the partition wall 70 do not reach inner side walls of the both longitudinal ends inside the developing container 41. In this manner, the first communication portion 23 and the second communication portion 24 are formed outside of the carrying area 30*b* of the developing sleeve 30. The first communication portion 23 is a route through which the developer is delivered from the agitating chamber 22 to the developing chamber 21. The second communication portion 24 is a route through which the developer is delivered from the developing chamber 21 to the agitating chamber 22.

On one longitudinal end side of the partition wall 70, there is formed a partition wall portion 51 as a second partition wall that is formed so as to abut against a side wall on one longitudinal end side of the developing container 41 through the first communication portion 23 therebetween. The partition wall portion 51 is disposed between a discharge portion 22*a* and a buffer portion 21*a*, which are described later, on one longitudinal end side of the first communication portion 23. Further, in the first embodiment, the partition wall portion 51 is formed so as to abut against both an upper surface and a bottom surface of the developing container 41, specifically, without forming gaps above and below the partition wall portion 51 from the developing container 41.

A developing screw 31 configured to convey the developer in a predetermined first direction in the developing chamber 21 is disposed in the developing chamber 21. An agitating screw 32 configured to convey the developer in a second direction opposite to the developer conveyance direction (first direction) of the developing screw 31 in the agitating chamber 22 is disposed in the agitating chamber 22. The developing screw 31 is constructed by forming a vane 31*b* in a spiral manner around a rotary shaft 31*a*. The agitating screw 32 is constructed by forming a vane 32*b* in a spiral manner around a rotary shaft 32*a*. Both ends of the rotary shaft 31*a* and both ends of the rotary shaft 32 are supported by bearing members 60 so as to be freely rotatable with respect to the developing container 41. The developing screw 31 and the agitating screw 32 are arranged so as to partially overlap as viewed in the horizontal direction. In the first embodiment, as illustrated in FIG. 2, the developing screw 31 and the agitating screw 32 are arranged so that a vertical position of the rotary shaft 31*a* and a vertical position of the rotary shaft 32*b* are approximately the same and that the developing screw 31 and the agitating screw 32 are parallel to each other.

In the following description, "upstream" and "downstream" of the developing chamber 21 denote upstream in the developer conveyance direction of the developing screw 31 and downstream in the developer conveyance direction of the developing screw 31, respectively, unless otherwise noted. Similarly, "upstream" and "downstream" of the agitating chamber 22 denote upstream in the developer conveyance direction of the agitating screw 32 and downstream in the developer conveyance direction of the agitating screw 32, respectively, unless otherwise noted.

As illustrated in FIG. 3, a return screw 321 as a return conveyance member is provided to a downstream end portion of the agitating screw 32 in the developer conveyance direction so as to be coaxial with the rotary shaft 32*a* of the agitating screw 32. The return screw 321 includes a vane 32*d* turning in a direction opposite to that of the vane 32*b* on the rotary shaft 32*a*, and is configured to convey the developer in the first direction opposite to the developer conveyance direction (second direction) of the agitating screw 32 in the agitating chamber 22. A conveying screw 322 is further provided to an upstream end portion of the return screw 321 in the developer conveyance direction so as to be coaxial with the rotary shaft 32*a*. The conveying screw 322 includes a vane 32*e* turning in the direction same as that of the vane 32*b* on the rotary shaft 32*a*, and is configured to convey the developer in the same direction as the developer conveyance direction (second direction) of the agitating screw 32 downstream of the agitating chamber 22, more specifically, in the discharge portion 22*a* described later. Further, a plurality of agitating ribs 32*c*, each having a predetermined width in the rotation axis direction (longitudinal direction), are arranged between pitches of the vane 32*b* on the agitating screw 32. The agitating ribs 32*c* are configured to agitate the developer in the agitating chamber 22 along with rotation of the agitating screw 32.

The developing sleeve 30, the developing screw 31, and the agitating screw 32, which includes the return screw 321 and the conveying screw 322, are configured to be driven by gear trains (not shown) in an interlocking manner, and are rotated through intermediation of the gear trains from a drive motor (not shown). By the rotation of the developing screw 31 and the agitating screw 32, the developer is circulated and conveyed inside the developing container 41. At this time, in the developer conveyance direction (second direction) of the agitating screw 32, the developer is delivered from the agitating chamber 22 to the developing chamber 21 through the first communication portion 23 downstream in the second direction, and is delivered from the developing chamber 21 to the agitating chamber 22 through the second communication portion 24 upstream in the second direction. In this manner, the developing chamber 21 and the agitating chamber 22 form a circulation route for the developer. The developer circulates through the circulation route so as to be mixed and agitated. As described later, however, when the amount of developer is relatively large along with replenishment of the supplement, a part of the developer conveyed by the agitating screw 32 is moved to the discharge portion 22*a* provided on the downstream of the first communication portion 23 without being delivered to the developing chamber 21.

In the developing chamber 21, the developer is supplied to the carrying area 30*b*of the developing sleeve 30. In the agitating chamber 22, the developer removed from the developing sleeve 30 is collected. Specifically, the developer in the developing chamber 21 is attracted by the developing sleeve 30 at a position of the scooping magnetic pole N1of the magnet roller 30*a* (see FIG. 2) while being conveyed by the developing screw 31. A guiding member 71 is provided to an upper portion of the partition wall 70. The guiding member 71 is provided to extend from an upper end of the partition wall 70 so as to be in proximity to the developing sleeve 30 in the vicinity of the non-magnetic region of the developing sleeve 30, and is configured so that the developer on the developing sleeve 30 is removed by the removal magnetic pole N3 and then is stored in the agitating chamber 22 without returning to the developing chamber 21. In the agitating chamber 22, the collected developer is conveyed by the agitating screw 32 while the developer is collected.

The developing apparatus 4 of the first embodiment has a so-called function separation type configuration in which the developer is supplied to the developing sleeve 30 in the developing chamber 21 and in which the developer is collected from the developing sleeve 30 in the agitating chamber 22. In the developing apparatus 4 of the function separation type described above, the developer on the developing sleeve 30 is collected in a longitudinal direction of the agitating chamber 22. Therefore, the developer is circulated through two routes including a route in which the developer is conveyed from the developing chamber 21 to the agitating chamber 22 without through the developing sleeve 30 and a route in which the developer is conveyed from the developing sleeve 30 directly to the agitating chamber 22. Thus, a distribution of the amount of developer is liable to be non-uniform inside the developing container 41. In particular, the developer is liable to accumulate on the downstream of the agitating chamber 22, and a surface level of the developer is liable to be higher.

As already described above, when the development is performed by using the dual-component developer, charging performance of the carrier for the toner is degraded along with the image formation. As a result, a toner charging amount is decreased, and hence an image defect is liable to occur. Therefore, in order to recover the charging performance of the carrier, there has been used an ACR process of replenishing the supplement from a replenishment port (not shown) formed upstream of the agitating chamber 22 to refresh the carrier. Even with the use of the ACR process, however, when the agitation of the developer is insufficient due to an excessively large amount of developer inside the developing container 41 with the replenishment of the supplement, the image defect may also occur. Therefore, in order to prevent excessive increase in amount of the developer in the developing container 41, a surplus developer is discharged from the discharge port 50 out of the developer container.

<Discharge Portion>

As illustrated in FIG. 3, in order to discharge the surplus developer, which is provided along with the replenishment of the supplement, out of the developing container, the discharge portion 22*a* is provided adjacent to the agitating chamber 22 on the downstream of the agitating chamber 22, that is, on the downstream in the second direction in the first embodiment. The upstream end portion of the return screw 321 in the developer conveyance direction, that is, an upstream end portion in the first direction, is at least partially arranged in the discharge portion 22*a*. In this manner, at least a part of the return screw 321 is surrounded by the partition wall 51 and the developing container 41 so as to secure a conveying force for the developer in the first direction by the return screw 321. A discharge port 50 for discharging the developer is formed in a bottom surface or a side surface of the developing container 41 on the upstream of the return screw 321 in the developer conveyance direction for the discharge portion 22*a*. Further, a wall surface 52 oriented so as to intersect with the rotation axis direction of the agitating screw 32 is formed on a near side of the discharge port 50, that is, on the upstream of the agitating chamber 22. The wall surface 52 has a through hole (not shown) through which the rotary shaft 32*a* without vane passes with a gap.

In the agitating chamber 22, the developer conveyed by the agitating screw 32 to the downstream of the agitating chamber 22 passes through the first communication portion 23 in accordance with pushback by the return screw 321 to be delivered to the developing chamber 21. At this time, after passing through the through hole of the wall surface 52, a part of the developer that passes over the return screw 321 without being pushed back by the return screw 321 is delivered to the discharge port 50 by the conveying screw 322 to be discharged out of the developing container. As described above, the agitating screw 32 and the return screw 321 convey the developer in the directions opposite to each other, thereby adjusting the developer to be discharged out of the developing container 41 in accordance with the amount of developer.

Along with increase in amount of developer in the developing container 41 by the replenishment of the supplement, the amount of developer to be discharged from the discharge port 50 increase relatively to lower the surface level of the developer in the agitating chamber 22. As a result, the amount of developer pushed back by the return screw 321 is increased, and hence most of the developer conveyed to the agitating screw 32 is delivered to the developing chamber 21. Specifically, the amount of developer discharged from the discharge port 50 is decreased.

In a case of the developing apparatus of the function separation type, the surface level of the developer is liable to be higher on the downstream of the agitating chamber 22 as already described above. Therefore, even when the amount of developer is relatively small such that the developer is not discharged without using the function separation type configuration, the developer may be continuously discharged in the developing apparatus of the function separation type. As a result, the amount of developer in the developing container 41 is excessively reduced, and a sufficient amount of developer cannot be supplied to the developing sleeve 30, resulting in occurrence of the image defect may be generated. In order to prevent the occurrence of the image defect, in the first embodiment, the buffer portion 21*a* serving as an escape for the developer is provided on the upstream of the developing chamber 21 adjacent to the discharge portion 22*a* provided to the agitating chamber 22.

<Buffer Portion>

The buffer portion 21*a* is provided more on upstream side of the developing chamber 21 than the first communication portion 23 of the developing chamber 21 so that the partition wall portion 51 is sandwiched between the discharge portion 22*a* and the buffer portion 21*a*. The buffer portion 21*a* is a space surrounded by an inner wall of the developing container 41 on the developing chamber 21 side and the partition wall portion 51. When the buffer portion 21*a* is provided, the developing chamber 21 is substantially expanded toward the upstream by the amount of the buffer portion 21*a* as compared with the related art.

The developer conveyed by the agitating screw 32 passes through the first communication portion 23 to be delivered from the agitating chamber 22 to the developing chamber 21 by the conveying force for the developer, which is generated by conveyance of the developer in the opposite orientations by the agitating screw 32 and the return screw 321. In a case of the first embodiment, however, the developer moves even into the buffer portion 21*a*. Therefore, the developer can be delivered smoothly even in the function separation type configuration in which the surface level of the developer becomes higher on the downstream of the agitating chamber 22, and thus it is hitherto difficult to sufficiently deliver the developer depending on the conveying force for the developer, which is generated by the agitating screw 32 and the return screw 321. Specifically, in the first embodiment, even when the surface level of the developer is liable to be higher on the downstream of the agitating chamber 22, the passage of the developer through the first communication portion 23 is facilitated by the buffer portion 21*a*. Therefore, the developer is delivered smoothly from the agitating chamber 22 to the developing chamber 21. When the buffer portion 21*a* is provided on the upstream of the developing chamber 21 as described above, the delivery of the developer from the agitating chamber 22 to the developing chamber 21 is promoted, thereby enabling suppression of a rise of the level surface of the developer, which is liable to be higher on the downstream of the agitating chamber 22. When the rise of the level surface of the developer on the downstream of the agitating chamber 22 can be suppressed, the amount of developer that passes over the return screw 321 to reach the discharge port 50 is reduced. Therefore, the developer is not discharged when the amount of developer is small.

As described above, in the first embodiment, the buffer portion 21*a* is provided more on the upstream of the developing chamber 21 than the first communication portion 23 of the developing chamber 21. The buffer portion 21*a* is provided so that the buffer portion 21*a* and the discharge portion 22*a* having the discharge port 50 sandwich the partition wall portion 51. Specifically, the partition wall portion 51 is disposed between the discharge portion 22*a* and the buffer portion 21*a* more on one longitudinal end side than the first communication portion 23. When the buffer portion 21a is provided on the upstream of the developing chamber 21, the delivery of the developer from the agitating chamber 22 to the developing chamber 21 through the first communication portion 23 can be promoted by the conveying force for the developer, which is generated by the agitating screw 32 and the return screw 321. As a result, the rise of the surface level of the developer, which is liable to be higher on the downstream of the agitating chamber 22, can be suppressed. Thus, excessive discharge of the developer due to the rise of the surface level despite of a small amount of developer can be reduced.

[Second Embodiment]

A second embodiment will be described with reference to FIG. 4 and FIG. 5. In the second embodiment, the above-mentioned buffer portion 21*a* is easily formed in the developing chamber 21 by only mounting a bearing member 60A to the developing container 41. In order to form the buffer portion 21*a* in the developing chamber 21, the partition wall portion 51 is not formed in the developing chamber 41 but is integrally formed with the bearing member 60A configured to support the rotary shaft 32*a* on the downstream of the agitating chamber 22 among the bearing members 60. The bearing member 60A is formed independently of the developing container 41, and is mounted to a downstream end of the developing container 41 in the second direction. Other configuration and functions are the same as those of the first embodiment described above. Therefore, the same components are denoted by the same reference symbols so as to omit or simplify description and illustration, and differences from the first embodiment are mainly described below.

<Bearing Member>

Figure 4:
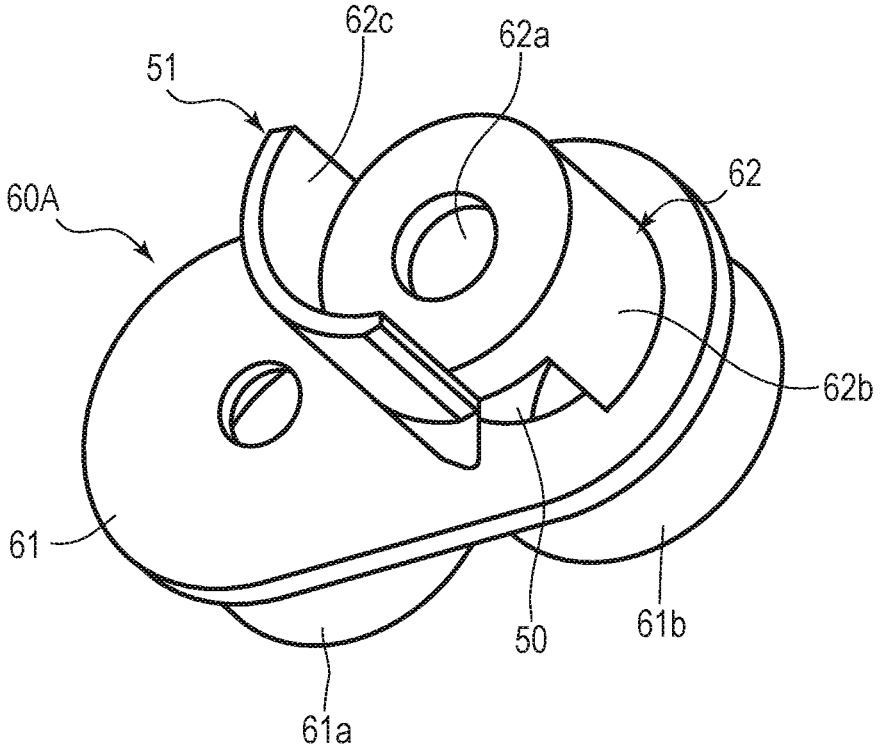
FIG. 4 is a perspective view for illustrating a bearing member according to a second embodiment.

The bearing member 60A of the second embodiment is illustrated in FIG. 4. The bearing member 60A illustrated in FIG. 4 includes a supporting portion 61 configured to pivotably support at least the rotary shaft 32*a* of the return screw 321, a tubular portion 62 provided so as to project from the supporting portion 61 in the first direction, and a wall portion 62*c* provided so as to extend from a side wall portion 62*b* of the tubular portion 62 in the first direction. The supporting portion 61 can be roughly divided into a first supporting portion 61*a* and a second supporting portion 61*b*. The first supporting portion 61*a* supports the developing screw 31 so as to be freely rotatable. The second supporting portion 61*b* supports the return screw 321 so as to be freely rotatable. The first supporting portion 61*a* and the second supporting portion 61*b* are formed integrally with each other. The supporting portion 61 closes a mounting hole 41*b* (see FIG. 5) of the developing container 41 in a state of being mounted to the developing container 41.

The tubular portion 62 has a through hole 62*a* through which the rotary shaft 32*a* passes with a gap from an outer periphery of the rotary shaft 32*a* of the return screw 321 on which the vane 32*d* is not formed. The through hole 62*a* is formed into, for example, a circular shape so as to match the outer periphery of the rotary shaft 32*a*. The discharge port 50 is formed in the tubular portion 62 so as to communicate with the through hole 62*a*. Therefore, the developer moving into a gap between the through hole 62*a* of the tubular portion 62 and the rotary shaft 32*a* passes through the tubular portion 62 so as to be discharged from the discharge port 50 out of the developing container 41. Although the tubular portion 62 is formed into, for example, a substantially cylindrical shape as illustrated in FIG. 4, a shape of the tubular portion 62 is not limited thereto. It is preferred that the tubular portion 62 be formed into a substantially cylindrical shape to match the return screw 321 so that the partition wall portion 51 is formed along an outer periphery of the return screw 321.

A wall portion 62*c* is formed on the side wall portion 62*b* of the tubular portion 62 on a side confronting the developing chamber 21 (see FIG. 3). The wall portion 62*c* is provided so as to extend from the side wall portion 62*b* in the first direction so as to form a part of the partition wall portion 51. Specifically, in a case of the second embodiment, the partition wall portion 51 includes the side wall portion 62*b* of the tubular portion 62 and the wall portion 62*c*. The partition wall portion 51 including the side wall portion 62*b* and the wall portion 62*c* projects from the supporting portion 61 in the first direction between the first supporting portion 61*a* and the second supporting portion 61*b*.

The wall portion 62*c* is formed into an arc shape so as to extend along the outer periphery of the return screw 321. In this manner, an interval between the vane 32*d* of the return screw 321 and the wall portion 62*c* can be reduced so as to secure the conveying force for the developer in the first direction, which is generated by the return screw 321. On the contrary, when the interval between the vane 32*d* of the return screw 321 and the wall portion 62*c* is large, it is difficult to convey the developer in the first direction by the return screw 321, causing difficulty in pushing back the developer. Therefore, it is preferred that the tubular portion 62 be formed into a substantially cylindrical shape having a diameter slightly larger than an outer diameter of the return screw 321 and that the wall portion 62*c* be formed on the side wall portion 62*b* of the tubular portion 62. In this manner, of the developer conveyed to the agitating screw 32, a part of the developer having passed over the return screw 321 for which the conveying force is secured by the wall portion 62*c* moves into the tubular portion 62 from the gap between the through hole 62*a* and the rotary shaft 32*a* to be discharged from the discharge port 50.

Although it is preferred that the partition wall portion 51 be formed into the arc shape as described above, a shape of the partition wall portion 51 is not limited thereto. For example, the shape may be another shape such as an oval shape or a linear shape. Further, the shape of the through hole 62*a* of the tubular portion 62 is not limited to the circular shape, and may be another shape such as an oval shape or a rectangle hole shape.

Figure 5:
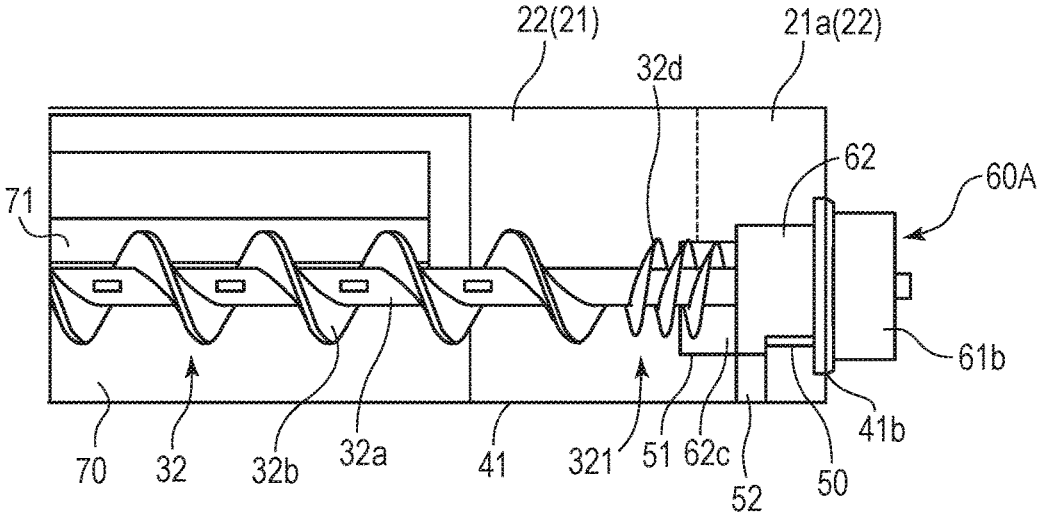
FIG. 5 is a sectional view for illustrating the developing apparatus according to the second embodiment in a partially enlarged manner.

As illustrated in FIG. 5, the bearing member 60A is mounted to a side wall of the developing container 41 on one longitudinal end side on the downstream of the agitating chamber 22. When the bearing member 60A is mounted to the developing container 41, the partition wall portion 51 including the side wall portion 62*b* and the wall portion 62*c* (see FIG. 4) projects in the first direction. As a result, the buffer portion 21*a* is formed so as to be adjacent to the tubular portion 62. In the second embodiment, the tubular portion 62 having the discharge port 50 corresponds to the above-mentioned discharge portion 22*a*.

Further, as illustrated in FIG. 5, when the bearing member 60A illustrated in FIG. 4 is mounted to the developing container 41, a larger gap is formed between an upper end of the return screw 321 and the developing container 41 above the return screw 321. As a result, when the surface level of the developer becomes higher than the upper end of the return screw 321, the developer can be delivered to the buffer portion 21*a* through the gap. Further, a gap is also formed below the return screw 321. Even through the gap, the developer can be delivered to the buffer portion 21*a*.

Even in a case of the second embodiment described above, the same effects as those of the first embodiment described above are obtained. Specifically, when the buffer portion 21*a* is provided on the upstream of the developing chamber 21, the rise of the surface level of the developer, which is liable to be higher on the downstream of the agitating chamber 22, can be suppressed. Thus, the excessive discharge of the developer due to the rise of the surface level in spite of a small amount of developer can be reduced. Further, in the case of the second embodiment, the buffer portion 21*a* can be easily formed by mounting the bearing member 60A to the developing container 41.

[Another Embodiment]

In the embodiments described above, description is made of the image forming apparatus 100 configured to primarily transfer the toner images of the respective colors from the photosensitive drums 1*a* to 1*d* of the respective colors onto the intermediate transfer belt 7, and then secondarily transfer a compound toner image of the respective colors onto the recording material P at a time. However, the image forming apparatus is not limited thereto. The developing apparatus according to the embodiments described above can also be applied to, for example, the image forming apparatus using a direct transfer process for transferring the toner images from the photosensitive drums 1*a* to 1*d* directly onto the recording material P that is carried and conveyed by a transfer member conveying belt.

According to the first and second embodiments, with the function separation type configuration using the carrier refresh process, the delivery of the developer from the agitating chamber to the developing chamber is promoted so as to enable the suppression of the rise of the surface level of the developer. Thus, the developer is not excessively discharged when the amount of developer is small.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-106742, filed May 27, 2016, which is hereby incorporated by reference herein in its entirety.

What is claimed is:

1. A developing apparatus, comprising:

a rotatable developer carrying member configured to carry a developer including toner and carrier to convey the developer to a developing area opposed to an image bearing member;

a developing container including:

a first chamber configured to supply the developer to the developer carrying member, the first chamber being disposed below a rotation axis of the developer carrying member in a state in which the developing apparatus is in a developing position for developing an electrostatic latent image formed on the image bearing member;

a second chamber disposed opposite to the developer carrying member in the state in which the developing apparatus is in the developing position and configured to collect the developer, that has passed the developing area, from the developer carrying member;

a first communication portion configured to permit the developer in the first chamber to communicate from the first chamber to the second chamber;

a second communication portion configured to permit the developer in the second chamber to communicate from the second chamber to the first chamber, the developing container being configured to circulate the developer to be supplied to the developer carrying member between the first chamber and the second chamber;

a first conveyance screw disposed in the first chamber and configured to convey the developer in the first chamber in a first conveyance direction from the second communication portion toward the first communication portion;

a second conveyance screw disposed in the second chamber and configured to convey the developer in the second chamber, the second conveyance screw including a rotary shaft, a first vane portion formed in a spiral manner around an outer circumference of the rotary shaft and configured to convey the developer in the second chamber in a second conveyance direction from the first communication portion toward the second communication portion, and a second vane portion provided downstream of the first vane portion in the second conveyance direction and formed in a spiral manner around the outer circumference of the rotary shaft and configured to convey the developer in the second chamber in the first conveyance direction and to deliver the developer in the second chamber to the second communication portion;

a magnet fixedly disposed inside the developer carrying member and including a first magnetic pole and a second magnetic pole disposed downstream of a local maximum peak position of a magnetic flux density of the first magnetic pole in a rotation direction of the developer carrying member and adjacent to the first magnetic pole, the second magnetic pole having the same polarity as the first magnetic pole, the magnet being configured to generate a magnetic field for removing the developer, that has passed the developing area, from a surface of the developer carrying member;

a partition wall provided between the first chamber and the second chamber and provided with a guiding portion disposed opposite to the developer carrying member to guide the developer that has passed the developing area to be collected from the developer carrying member into the second chamber, a position in which the guiding portion is closest to the developer carrying member is downstream of the local maximum peak position of the magnetic flux density of the first magnetic pole and upstream of a local maximum peak position of a magnetic flux density of the second magnetic pole in the rotation direction of the developer carrying member; and a developer replenishing portion configured to replenish the developer; and a bearing member which is formed separately from the developing container and attached to the developing container, the bearing member configured to rotatably bear the rotary shaft, the bearing member including a bearing portion, a developer discharge portion, and a wall portion, the bearing portion being disposed upstream of the second vane portion in the first conveyance direction and configured to rotatably bear the rotary shaft, the developer discharge portion being disposed upstream of the second vane portion in the first conveyance direction and configured to discharge a part of the developer as the developer is replenished by the developer replenishing portion, the wall portion being disposed opposite to the second vane portion in the first conveyance direction, with a predetermined clearance in between the second vane portion and the wall portion and formed so as to extend along an outer periphery of the second vane portion, wherein the developer discharge portion is disposed in a predetermined area of the second chamber in which the developer of the second chamber is deliverable to the second communication portion, and wherein the developer discharge portion is provided in a bottom portion in the predetermined area of the second chamber in the state in which the developing apparatus is in the developing position.

2. A developing apparatus according to claim 1, wherein the bearing portion, the developer discharge portion, and the wall portion are integrally formed with one another.

3. A developing apparatus according to claim 1, wherein an uppermost part of the second communication portion is above an uppermost part of the wall portion in a vertical direction in the state in which the developing apparatus is in the developing position.

4. A developing apparatus according to claim 1, wherein the wall portion is formed into an arc shape along the outer periphery of the second vane portion.

5. A developing apparatus according to claim 1, wherein the bearing member further includes a second bearing portion, the second bearing portion being disposed upstream of a vane portion of the first conveyance screw in the first conveyance direction and configured to rotatably bear a rotary shaft of the first conveyance screw.

6. A developing apparatus according to claim 5, wherein the bearing portion, the second bearing portion, the developer discharge portion, and the wall portion are integrally formed with one another.

* * * * *